US010960705B1

(12) United States Patent
Yu

(10) Patent No.: US 10,960,705 B1
(45) Date of Patent: Mar. 30, 2021

(54) DETACHABLE AND RETRACTABLE PEN

(71) Applicant: Hangzhou Jianyi Technology Co., Ltd., Zhejiang (CN)

(72) Inventor: Chengpeng Yu, Zhejiang (CN)

(73) Assignee: Hangzhou Jianyi Technology Co., Ltd., Hangzhou (CN)

( * ) Notice: Subject to any disclaimer, the term of this patent is extended or adjusted under 35 U.S.C. 154(b) by 0 days.

(21) Appl. No.: 17/069,793

(22) Filed: Oct. 13, 2020

(30) Foreign Application Priority Data

Dec. 22, 2019 (CN) ..... 201911332574.8

(51) Int. Cl.
*B43K 24/04* (2006.01)
*B43K 25/02* (2006.01)

(52) U.S. Cl.
CPC ..... *B43K 24/04* (2013.01); *B43K 25/028* (2013.01)

(58) Field of Classification Search
CPC ..... B43K 24/02; B43K 24/04; B43K 24/082; B43K 24/088; B43K 25/028
See application file for complete search history.

(56) References Cited

U.S. PATENT DOCUMENTS 4,717,275 A * 1/1988 Burkhardt, Jr. ..... B43K 25/028 401/104
7,331,730 B2 * 2/2008 Fukui ..... B43K 5/17 401/108
8,100,598 B2 * 1/2012 Killion ..... B43K 23/001 401/100
8,434,957 B2 * 5/2013 Kageyama ..... B43K 7/00 401/114
10,052,906 B2 * 8/2018 Cheon ..... B43K 27/12

FOREIGN PATENT DOCUMENTS

| | | | |
|---|---|---|---|
| CN | 1711175 | A | 12/2005 |
| CN | 101010206 | A | 8/2007 |
| CN | 201161500 | Y | 12/2008 |
| CN | 101883687 | A | 11/2010 |
| CN | 102529508 | A | 7/2012 |
| CN | 102821972 | A | 12/2012 |
| CN | 208682418 | U | 4/2019 |
| CN | 110239257 | A | 9/2019 |
| DE | 683614 | C | 11/1939 |
| EP | 2201859 | A1 | 6/2010 |
| JP | H0872478 | A | 3/1996 |
| JP | 2019136909 | A | 8/2019 |
| JP | 2019177639 | A | 10/2019 |
| KR | 20010035755 | A | 5/2001 |

* cited by examiner

*Primary Examiner* — David P Angwin
*Assistant Examiner* — Bradley S Oliver

(57) ABSTRACT

A detachable and retractable pen includes a holder, a barrel, a cap and a push component. The holder is in threaded connection with a front end of the barrel. The cap is in snap-fit with a rear end of the barrel. A refill is placed inside the barrel and the holder. The push component is configured to drive the axial sliding of the refill in the barrel, so that the pen refill can slide axially by means of the lateral movement of the push component, achieving the exposing and hiding of the pen tip.

7 Claims, 3 Drawing Sheets

DETACHABLE AND RETRACTABLE PEN

CROSS-REFERENCE TO RELATED APPLICATIONS

This application claims the benefit of priority from Chinese Patent Application No. 201911332574.8, filed on Dec. 22, 2019. The content of the aforementioned application, including any intervening amendments thereto, is incorporated herein by reference in its entirety.

TECHNICAL FIELD

The present application relates to stationery, and more particularly to a detachable and retractable pen.

BACKGROUND

A pen is essential for students and those whose work involves writing. Currently, the commonly-used pens include a push-type mechanical pen and a pen with a cap (i.e., a traditional pen). For the pen with a cap, the holder is in threaded connection with the barrel in which the pen refill is placed.

When exposing to excessive external force or experiencing a falling during use, the traditional pen may easily suffer a crack at the holder, so that the pen refill is prone to waggling in use, affecting the normal writing. At the same time, after the cap is removed, the exposed pen tip will easily contaminate clothes or paper with ink, which is troublesome to clean. With regard to the push-type pen, when the rear cap is accidentally dropped during use, the spring is inclined to fall off the barrel, which further results in a failure to normally use the pen, so that it needs to replace the barrel, resulting in a waste of resources. In addition, the position deviation of the internal spring will render the pressing less flexible in use, and thus it may need to repeat to press several times to realize the normal use of the push-type pen. Moreover, since the pressing force required to expose the pen tip is relatively small, the ink in the pen refill will contaminate other objects when the rear cap of the push-type pen is accidentally pressed by other objects in the bag.

SUMMARY

An object of the application is to provide a detachable and retractable pen to overcome the defects in the prior art, where the refill can be driven to axially slide in the barrel by means of the lateral movement of the push component, thereby realizing the exposure and hiding of the pen tip. Moreover, the refill is always under stable fixation, which not only reduces the consumption of pen case, but also ensures that the pen tip will not be pushed out when the external force applied to the push component is small, protecting the refill from being damaged by collision and preventing other objects from being contaminated with ink.

Technical solutions of this application are specifically described as follows.

This application provides a detachable and retractable pen, comprising:

a holder;

a barrel;

a cap; and a push component;

wherein the holder is in threaded connection with a front end of the barrel; the cap is in snap-fit with a rear end of the barrel; a refill is placed in the barrel and the holder; the push component is configured to drive the refill to slide axially along the barrel; a first hole is provided on an outer wall of the rear end of the barrel to enable the push component to slide axially in the barrel; a reset spring is provided between an end of the push component inside the barrel and the cap; the refill is engaged with a front portion of the push component in the barrel;

two limit clamps are symmetrically provided in the push component; and the two limit clamps are in snap-fit with the barrel, respectively;

two fixing structures are symmetrically provided on an inner wall of the rear end of the barrel for positioning of the two limit clamps; and a guide structure is provided on the inner wall of the rear end of the barrel and is configured to drive the two limit clamps to be respectively in snap-fit with the fixing structures;

when the push component is pushed backwards, the two limit clamps separate from the fixing structures and the two limit clamps approach each other; and the reset spring is pressed by the push component to slide axially along the barrel to a first position;

when the push component is released, the push component is driven under an action of the reset spring to slide axially along the barrel to a second position such that the guide structure drives the two limit clamps to separate from each other and be respectively in snap-fit with the fixing structures again and a tip of the refill emerges from the holder; and when pushed backwards again, the push component drives the two limit clamps to separate from the fixing structures and then be in snap-fit with the fixing structures again such that the tip of the refill is hidden in the holder.

The refill can axially slide in the barrel through the lateral movement of the push component, thereby enabling a tip of the refill to emerge or hide in the holder. Moreover, the refill is always under stable fixation, which not only reduces the consumption of pen case, but also ensures that the pen tip will not be pushed out when the external force applied to the push component is relatively small, protecting the refill from being damaged by collision and preventing external objects from being contaminated with ink.

In some embodiments, the push component comprises a pen clip and a sliding cylinder; the pen clip is fixedly connected to a side of the sliding cylinder and is located outside the barrel; a rear portion of the sliding cylinder is fixed with a positioning cylinder; the reset spring is located between the positioning cylinder and the cap; a connecting plate is fixed on an inner wall of a front portion of the sliding cylinder; a pen groove is formed between the connecting plate and the inner wall of the front portion of the sliding cylinder to enable the refill to be in snap-fit therewith; an outer wall of the sliding cylinder is provided with two second holes which are symmetrical with respect to an axis of the sliding cylinder; and the limit clamps are fixed at a rear side of the connecting plate.

In use, the pen clip is pushed backwards to allow the sliding cylinder to drive the refill to move backwards along the axial direction of the barrel. Then the positioning cylinder presses the reset spring, and at the same time, the limit fixture blocks are gradually separated from the first grooves, respectively. After the pen clip is released, under the elastic force of the reset spring, the sliding cylinder drives the refill to move forwards in the axial direction of the barrel such that the two limit fixture blocks are respectively in snap-fit with the two second grooves under the action of the guide column to expose the pen tip.

In some embodiments, a distance between a rear end of the first hole and a rear end of the pen clip is larger than or equal to a maximum elastic displacement of the reset spring, and smaller than or equal to a distance between the positioning cylinder and the cap, so that when the push component is pushed backwards to be close to the rear end of the second hole, the reset spring just reaches or has reached the maximum elastic limit. At this point, it can reduce the occurrence that when the push component is pushed to the maximum, the elastic force generated by the reset spring is too small to push the pen tip out of the holder. Meanwhile, the positioning cylinder does not abut against or just abuts against the cap, so that there is enough distance between the positioning cylinder and the cap to enable the push component to drive the positioning cylinder to press the reset spring when the refill is hidden (initial state).

In some embodiments, each limit clamp comprises one limit fixture block, the two limit fixture blocks are symmetrically fixed at the rear side of the connecting plate; a sliding surface is provided on an outer wall of a rear portion of each limit fixture block; ends of the limit fixture blocks away from the connecting plate protrude from the second holes and are respectively in snap-fit with the fixing structures; the rear portion of each limit fixture block is fixed with a magnet column; adjacent magnetic poles of the two magnet columns are opposite; and a magnetic attraction force between the two magnet columns is less than an elastic force of the reset spring.

When the push component is pushed backwards, the two limit fixture blocks gradually approach under the guidance of two first guide surfaces and the attraction force between the two magnet columns. After the push component is released, the two limit fixture blocks follow the push component to move forwards in the axial direction of the barrel. When moving to contact with the guide column, the two limit fixture blocks are separated and move along the two sides of the guide column to be in snap-fit with the two second grooves, respectively, under the elastic force of the reset spring and the blocking action of the guide column.

In some embodiments, opposite surfaces of the two limit fixture blocks are provided with a positioning block and a positioning groove, respectively; and the positioning block and the positioning groove are in snap-fit with each other. The pen clip is pushed backwards to drive the end of each limit fixture block away from the connecting plate to separate from the first groove, and then the two limit fixture blocks gradually approach and get clamped with each other through the snap fit between the positioning block and the positioning groove, such that the two limit fixture blocks can continue to move backwards in the barrel. After it is convenient to release the pen clip, the two limit fixture blocks can cross an end of the second guide surface close to the guide column.

In some embodiments, each fixing structure comprises a first groove and a second groove; the first groove and the second groove are provided on the inner wall of the rear end of the barrel; a rear portion of the first groove is provided with a first guide surface; a rear portion of the second groove is provided with a second guide surface; the end of each limit fixture block away from the connecting plate is in snap-fit with the first groove; and the sliding surface is in contact with the first guide surface. The pen clip is pushed backwards to drive the limit fixture blocks to be away from the first grooves, and the sliding surface slides on the first guide surface to be gradually separated from the first guide surface. After releasing the pen clip, the sliding cylinder drives the limit fixture blocks to move forwards in the axial direction of the barrel under the elastic force of the reset spring until the end of each limit fixture block away from the connecting plate is in snap-fit with the second groove. At this time, the sliding surface abuts against the second guide surface.

In some embodiments, the first guide surface is larger than the second guide surface in area, which ensures that there is enough displacement space for the sliding surface on the first guide surface when the push component is pushed backwards to the limit fixture block, so that after the pushing is stopped, the sliding surface can cross the end of the second guide surface close to the guide column to expose the pen tip.

In some embodiments, the guide structure comprises a cushion block fixed on the inner wall of the rear end of the barrel and a guide column fixed on the cushion block; the cushion block is provided at an inner wall of a side of the barrel away from the pen clip, and is located at a center line of the inner wall of the side of the barrel away from the pen clip; a maximum distance between the cushion block and the inner wall of the side of the barrel away from the pen clip is lower than a maximum distance between the first groove and the inner wall of the side of the barrel away from the pen clip and a maximum distance between the second groove and the inner wall of the side of the barrel away from the pen clip; and the guide column is located between the two limit fixture blocks. After the pen clip is released, the sliding cylinder drives the two limit fixture blocks to move forwards along the axial direction of the barrel under the action of the reset spring, so that the two limit fixture blocks can be separated under the blocking action of the guide column and they are respectively in snap-fit with the second grooves, fixing the refill exposed outside the holder.

In some embodiments, a maximum distance between a surface of the guide column close to the pen clip and the inner wall of the side of the barrel away from the pen clip is larger than a maximum distance between a surface of each limit fixture block away from the pen clip and the inner wall of the side of the barrel away from the pen clip. When the push component is pushed to expose the pen tip, the two limit fixture blocks drive the push component to move forwards along the axial direction of the barrel under the elastic force of the reset spring, so that when passing through the guide column, the two limit fixture blocks can be separated due to the blocking effect of the guide column by properly arranging the guide column.

In some embodiments, a positioning protrusion is fixed on a surface of the cap located inside the barrel; and the positioning protrusion is inserted into the reset spring, which makes the reset spring not prone to twisting and slipping out of the positioning cylinder when the push component is pushed backwards to press the reset spring. Similarly, after the push component is released, the reset spring cannot easily pop out of the positioning cylinder under the action of its own elastic force, so that the exposing and hiding of the refill can be performed normally.

The present disclosure has the following beneficial effects compared to the prior art.

1) In the present disclosure, the axial sliding of the refill in the barrel can be realized through the lateral movement of the push component, thereby enabling a tip of the refill to emerge or hide in the holder. Moreover, the refill is always under stable fixation, which not only reduces the consumption of pen case, but also ensures that the pen tip will not be pushed out when the external force applied to the push component is small, protecting the refill from being damaged by collision and preventing external objects from being contaminated with ink.

2) The push component includes a pen clip and a sliding cylinder. The pen clip is fixedly connected to a side of the sliding cylinder and is located outside the barrel. A rear portion of the sliding cylinder is fixed with a positioning cylinder. The reset spring is located between the positioning cylinder and the cap. A connecting plate is fixed on an inner wall of a front portion of the sliding cylinder. A pen groove is formed between the connecting plate and the inner wall of the front portion of the sliding cylinder to enable the refill to be in snap-fit therewith. An outer wall of the sliding cylinder is provided with two second holes which are symmetrical with respect to an axis of the sliding cylinder. The limit clamps are fixed at a rear side of the connecting plate.

In use, the pen clip is pushed backwards to allow the sliding cylinder to drive the refill to move backwards along the axial direction of the barrel. Then the positioning cylinder presses the reset spring, and at the same time, the limit fixture blocks are gradually separated from the first grooves, respectively. After the pen clip is released, under the elastic force of the reset spring, the sliding cylinder drives the refill to move forwards in the axial direction of the barrel such that two limit fixture blocks are respectively in snap-fit with the two second grooves under the action of the guide column to expose the pen tip.

3) A distance between a rear end of the first hole and a rear end of the pen clip is larger than or equal to a maximum elastic displacement of the reset spring, and smaller than or equal to a distance between the positioning cylinder and the cap, so that when the push component is pushed backwards to be close to the rear end of the first hole, the reset spring just reaches or has reached the maximum elastic limit. At this point, it can reduce the occurrence that when the push component is pushed to the maximum, the elastic force generated by the reset spring is too small to push the pen tip out of the holder. Meanwhile, the positioning cylinder does not abut against or just abuts against the cap, so that there is enough distance between the positioning cylinder and the cap to enable the push component to drive the positioning cylinder to press the reset spring when the refill is hidden (initial state).

4) Each limit clamp includes one limit fixture block, the two limit fixture blocks are symmetrically fixed at the rear side of the connecting plate. A sliding surface is provided on an outer wall of a rear portion of each limit fixture block. The ends of the limit fixture blocks away from the connecting plate protrude from the second holes and are respectively in snap-fit with the fixing structures. The rear portion of each limit fixture block is fixed with a magnet column. The adjacent magnetic poles of the two magnet columns are opposite; and a magnetic attraction force between the two magnet columns is less than an elastic force of the reset spring.

When the push component is pushed backwards, two limit fixture blocks gradually approach under the guidance of two first guide surfaces and the attraction force between the two magnet columns. After the push component is released, the two limit fixture blocks follow the push component to move forwards in the axial direction of the barrel. When moving to contact with the guide column, the two limit fixture blocks are separated and move along the two sides of the guide column to be in snap-with the two second grooves, respectively, under the elastic force of the reset spring and the blocking action of the guide column.

5) Opposite surfaces of the two limit fixture blocks are provided with a positioning block and a positioning groove, respectively. The positioning block and the positioning groove are in snap-fit with each other. The pen clip is pushed backwards to drive the end of each limit fixture block away from the connecting plate to separate from the first groove, and then the two limit fixture blocks gradually approach and get clamped with each other through the snap fit between the positioning block and the positioning groove, such that the two limit fixture blocks can continue to move backwards in the barrel. After it is convenient to release the pen clip, the two limit fixture blocks can cross an end of the second guide surface close to the guide column.

6) Each fixing structure includes a first groove and a second groove. The first groove and the second groove are provided on the inner wall of the rear end of the barrel. A rear portion of the first groove is provided with a first guide surface. A rear portion of the second groove is provided with a second guide surface. The end of each limit fixture block away from the connecting plate is in snap-fit with the first groove. The sliding surface is in contact with the first guide surface.

The pen clip is pushed backwards to drive the limit fixture blocks to be away from the first grooves, and the sliding surface slides on the first guide surface to be gradually separated from the first guide surface. After the pen clip is released, the sliding cylinder drives the limit fixture blocks to move forwards in the axial direction of the barrel under the elastic force of the reset spring until the end of each limit fixture block away from the connecting plate is in snap-fit with the second groove. At this time, the sliding surface abuts against the second guide surface.

7) The first guide surface is larger than the second guide surface in area, which ensures that there is enough displacement space for the sliding surface on the first guide surface when the push component is pushed backwards to the limit fixture block, so that after the pushing is stopped, the sliding surface can cross the end of the second guide surface close to the guide column to expose the pen tip.

8) The guide structure includes a cushion block fixed on the inner wall of the rear end of the barrel and a guide column fixed on the cushion block. The cushion block is provided at an inner wall of a side of the barrel away from the pen clip, and is located at a center line of the inner wall of the side of the barrel away from the pen clip. A maximum distance between the cushion block and the inner wall of the side of the barrel away from the pen clip is lower than a maximum distance between the first groove and the inner wall of the side of the barrel away from the pen clip and a maximum distance between the second groove and the inner wall of the side of the barrel away from the pen clip. The guide column is located between the two limit fixture blocks. After the pen clip is released, the sliding cylinder drives the two limit fixture blocks to move forwards along the axial direction of the barrel under the action of the resey spring, so that the two limit fixture blocks can be separated under the blocking action of the guide column and they are respectively in snap-fit with the second grooves, fixing the refill exposed outside the holder.

9) A maximum distance between a surface of the guide column close to the pen clip and the inner wall of the side of the barrel away from the pen clip is larger than a maximum distance between a surface of each limit fixture block away from the pen clip and the inner wall of the side of the barrel away from the pen clip. When the push component is pushed to expose the pen tip, the two limit fixture blocks drive the push component to move forwards along the axial direction of the barrel under the elastic force of the reset spring, so that when passing through the guide column, the two limit fixture blocks can be separated due to the blocking effect of the guide column by properly arranging the guide column.

10) A positioning protrusion is fixed on a surface of the cap located inside the barrel; and the positioning protrusion is inserted into the reset spring, which makes the reset spring not prone to twisting and slipping out of the positioning cylinder when the push component is pushed backwards to press the reset spring. Similarly, after the push component is released, the reset spring cannot easily pop out of the positioning cylinder under the action of its own elastic force, so that the exposing and hiding of the refill can be performed normally.

Figure 1:
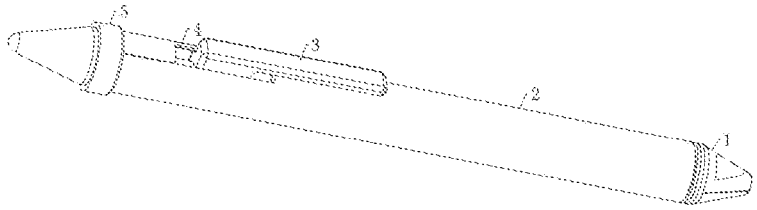
FIG. 1 is a perspective view of a detachable and retractable pen according to an embodiment of the present disclosure.

In the drawings: 1, holder; 2, barrel; 3, push component; 31, pen clip; 32, sliding cylinder; 321, connecting plate; 322, second hole; 33, positioning cylinder; 34, limit fixture block; 341, magnet column; 342, positioning groove; 343, positioning block; 344, sliding surface; 4, first hole; 5, cap; 51, positioning protrusion; 6, reset spring; 7, guide structure; 71, cushion block; 72, guide column; 8*a*, first groove; 8*b*, second groove; 81, first guide surface; 82, second guide surface; and 9, limit clamp.

DETAILED DESCRIPTION OF EMBODIMENTS

The technical solutions in the embodiments of the present disclosure will be clearly and completely described below with reference to the drawings.

As shown in FIGS. 1-8, a detachable and retractable pen includes a holder 1, a barrel 2 and a cap 5.

The holder 1 is in threaded connection with a front end of the barrel 2. The cap 5 is in snap-fit with a rear end of the barrel 2. A positioning protrusion 51 is fixed on a surface of the cap 5 located inside the barrel 2. The positioning protrusion 51 is inserted into a reset spring 6, which makes the reset spring 6 not prone to twisting and slipping out of the positioning cylinder 33 when the push component 3 is pushed backwards to press the reset spring 6. Similarly, after the push component 3 is released, the reset spring 6 cannot easily pop out of the positioning cylinder 33 under the action of its own elastic force, ensuring the normal exposing and hiding of the refill. The refill is placed in the barrel 2 and the holder 1.

The detachable and retractable pen further includes a push component 3 configured to drive the refill to slide axially along the barrel 2. A first hole 4 is provided on an outer wall of the rear end of the barrel 2 to enable the push component 3 to slide axially in the barrel 2. The reset spring 6 is provided between an end of the push component 3 inside the barrel 2 and the cap 5. The refill is engaged with a front portion of the push component 3 in the barrel 2.

Figure 6:
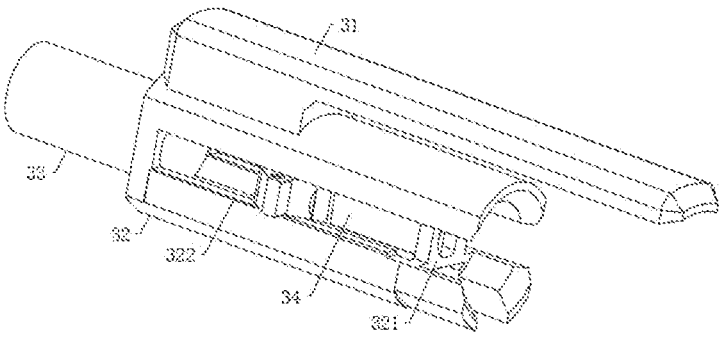
FIG. 6 is a perspective view of a push component of a detachable and retractable pen according to an embodiment of the present disclosure.
Figure 7:
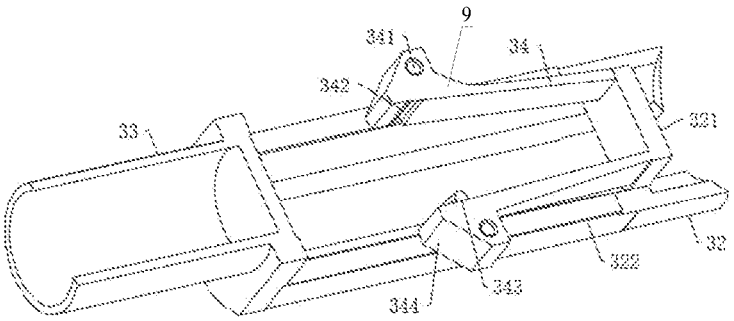
FIG. 7 is a cross-sectional view of the push component of a detachable and retractable pen according to an embodiment of the present disclosure.

In an embodiment shown in FIGS. 6-7, the push component 3 includes a pen clip 31 and a sliding cylinder 32. The pen clip 31 is fixedly connected to a side of the sliding cylinder 32 and is located outside the barrel 2. A rear portion of the sliding cylinder 32 is fixed with a positioning cylinder 33. The reset spring 6 is located between the positioning cylinder 33 and the cap 5. A connecting plate 321 is fixed on an inner wall of a front portion of the sliding cylinder 32. A pen groove is formed between the connecting plate 321 and the inner wall of the front portion of the sliding cylinder 32 to enable the refill to be snap-fit therewith. An outer wall of the sliding cylinder 32 is provided with two second holes 322 which are symmetrical with respect to an axis of the sliding cylinder 32. The limit clamps 9 are fixed at a rear side of the connecting plate 321.

In use, the pen clip 31 is pushed backwards to allow the sliding cylinder 32 to drive the refill to move backwards along the axial direction of the barrel 2. Then the positioning cylinder 33 presses the reset spring 6, and at the same time, the limit fixture blocks 34 are gradually separated from the first grooves 8*a*, respectively. After the pen clip 31 is released, under the elastic force of the reset spring 6, the sliding cylinder 32 drives the refill to move forwards in the axial direction of the barrel 2 such that the two limit fixture blocks 34 are respectively in snap-fit with the two second grooves 8*b* under the action of the guide column 72 to expose the pen tip.

Figure 2:
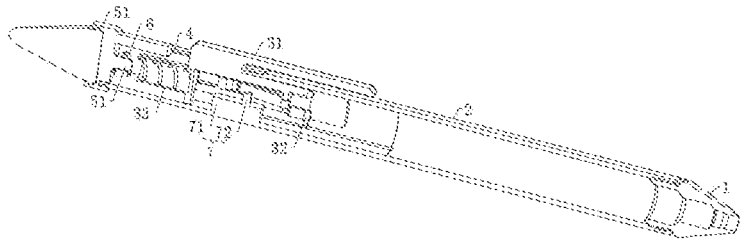
FIG. 2 is a sectional view of a detachable and retractable pen according to an embodiment of the present disclosure.

As shown in FIG. 2, a distance between a rear end of the first hole 4 and a rear end of the pen clip 31 is larger than or equal to a maximum elastic displacement of the reset spring 6, and smaller than or equal to a distance between the positioning cylinder 33 and the cap 5, so that when the push component 3 is pushed backwards to be close to the rear end of the first hole 4, the reset spring 6 just reaches or has reached the maximum elastic limit. At this point, it can reduce the occurrence that when the push component 3 is pushed to the maximum, the elastic force generated by the reset spring 6 is too small to push the pen tip out of the holder 1. Meanwhile, the positioning cylinder 33 does not abut against or just abuts against the cap 5, so that there is enough distance between the positioning cylinder 33 and the cap 5 to enable the push component 3 to drive the positioning cylinder 33 to press the reset spring 6 when the refill is hidden (initial state).

Figure 4:
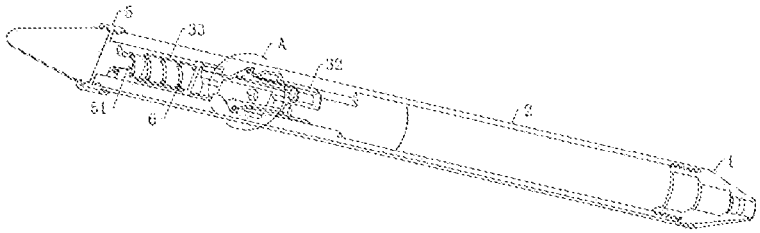
FIG. 4 is a cross-section view of a detachable and retractable pen according to an embodiment of the present disclosure.
Figure 5:
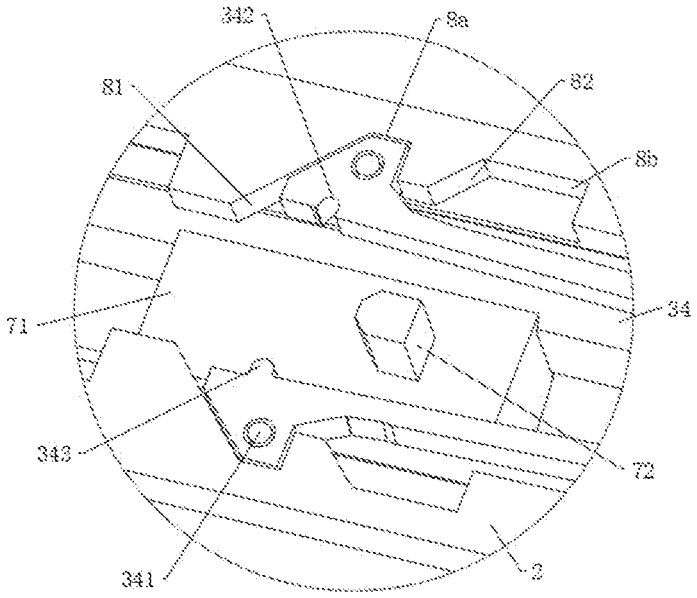
FIG. 5 is an enlarged view of the portion marked with A in FIG. 4.

Referring to FIGS. 4-5 and 7, two limit clamps 9 are symmetrically provided in the push component 3. The two limit clamps 9 are in snap-fit with the barrel 2, respectively. Each limit clamp 9 includes one limit fixture block 34, the two limit fixture blocks 34 are symmetrically fixed at the rear side of the connecting plate 321. A sliding surface 344 is provided on an outer wall of a rear portion of each limit fixture block 34. The ends of the limit fixture blocks 34 away from the connecting plate 321 protrude from the second holes 322 and are respectively in snap-fit with the fixing structures. The rear portion of each limit fixture block 34 is fixed with a magnet column 341. The adjacent magnetic poles of the two magnet columns 341 are opposite, and a magnetic attraction force between the two magnet columns 341 is less than an elastic force of the reset spring 6. When the push component 3 is pushed backwards, the two limit fixture blocks 34 gradually approach under the guidance of two first guide surfaces 81 and the attraction force between the two magnet columns 341. After the push component 3 is released, the two limit fixture blocks 34 follow the push component 3 to move forwards in the axial direction of the barrel 2. When moving to the guide column 72, the two limit fixture blocks 34 are separated and move along the two sides of the guide column 72 to be in snap-fit with the two second grooves 8*b*, respectively, under the elastic force of the reset spring 6 and the blocking action of the guide column 72.

In an embodiment shown in FIG. 5, opposite surfaces of the two limit fixture blocks 34 are provided with a positioning block 343 and a positioning groove 342, respectively. The positioning block 343 and the positioning groove 342 are in snap-fit with each other. The pen clip 31 is pushed backwards to drive the end of each limit fixture block 34 away from the connecting plate 321 to separate from the first groove 8*a*, and then the two limit fixture blocks 34 gradually approach and get clamped with each other through the clamping between the positioning block 343 and the positioning groove 342, such that the two limit fixture blocks 34 can continue to move backwards in the barrel 2. After it is convenient to release the pen clip 31, the two limit fixture blocks 34 can cross an end of the second guide surface 82 close to the guide column 72.

Figure 8:
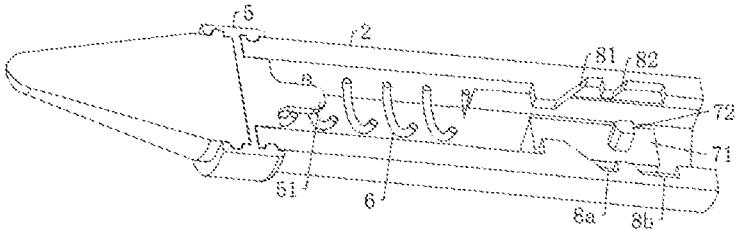
FIG. 8 is a cross-sectional view showing part of a barrel, a fixing structure and a guide structure of a detachable and retractable pen according to an embodiment of the present disclosure.

As shown in FIG. 8, the two fixing structures are symmetrically provided on an inner wall of the rear end of the barrel 2 for positioning of the two limit clamps 9. Each fixing structure includes a first groove 8*a* and a second groove 8*b*. The first groove 8*a* and the second groove 8*b* are provided on the inner wall of the rear end of the barrel 2. A rear portion of the first groove 8*a* is provided with a first guide surface 81. A rear portion of the second groove 8*b* is provided with a second guide surface 82. The end of each limit fixture block 34 away from the connecting plate 321 is in snap-fit with the first groove 8*a*. The sliding surface 344 is in contact with the first guide surface 81. The pen clip 31 is pushed backwards to drive the limit fixture blocks 34 to be away from the first grooves 8*a*, and the sliding surface 344 slides on the first guide surface 81 to be gradually separated from the first guide surface 81. After releasing the pen clip 31, the sliding cylinder 32 drives the limit fixture blocks 34 to move forwards in the axial direction of the barrel 2 under the elastic force of the reset spring 6 until the end of each limit fixture block 34 away from the connecting plate 321 is in snap-fit with the second groove 8*b*. At this time, the sliding surface 344 abuts against the second guide surface 82.

The first guide surface 81 is larger than the second guide surface 82 in area, which ensures that there is enough displacement space for the sliding surface 344 on the first guide surface 81 when the push component 3 is pushed backwards to the limit fixture block, so that after the pushing is stopped, the sliding surface 344 can cross the end of the second guide surface 82 close to the guide column 72 to expose the pen tip.

Figure 3:
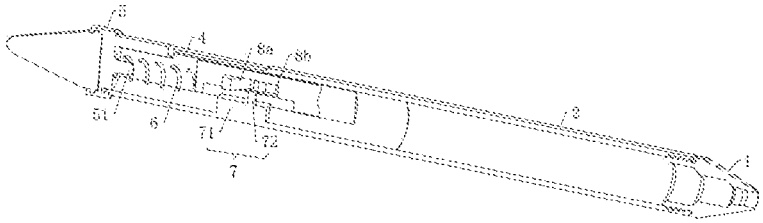
FIG. 3 is a sectional view of a fixing structure and a guide structure of a detachable and retractable pen according to an embodiment of the present disclosure.

In an embodiment shown in FIG. 3, a guide structure 7 is provided on the inner wall of the rear end of the barrel 2 and is configured to drive the limit clamps 9 to be respectively in snap-fit with the fixing structures. The guide structure 7 includes a cushion block 71 fixed on the inner wall of the rear end of the barrel 2 and a guide column 72 fixed on the cushion block 71. The cushion block 71 is provided at an inner wall of a side of the barrel 2 away from the pen clip 31, and is located at a center line of the inner wall of the side of the barrel 2 away from the pen clip 31. A maximum distance between the cushion block 71 and the inner wall of the side of the barrel 2 away from the pen clip 31 is lower than a maximum distance between the first groove 8*a* and the inner wall of the side of the barrel 2 away from the pen clip 31 and a maximum distance between the second groove 8*b* and the inner wall of the side of the barrel 2 away from the pen clip 31. The guide column 72 is located between the two limit fixture blocks 34. After the pen clip 31 is released, the sliding cylinder 32 drives the two limit fixture blocks 34 to move forwards along the axial direction of the barrel 2 under the action of the reset spring 6, so that the two limit fixture blocks 34 can be separated under the blocking action of the guide column 72 and they are respectively in snap-fit with the second grooves 8*b*, fixing the refill exposed outside the holder 1.

A maximum distance between a surface of the guide column 72 close to the pen clip 31 and the inner wall of the side of the barrel 2 away from the pen clip 31 is larger than a maximum distance between a surface of each limit fixture block 34 away from the pen clip 31 and the inner wall of the side of the barrel 2 away from the pen clip 31. When the push component 3 is pushed to expose the pen tip, the two limit fixture blocks 34 drive the push component 3 to move forwards along the axial direction of the barrel 2 under the elastic force of the reset spring 6, so that when passing through the guide column 72, the two limit fixture blocks 34 can be separated due to the blocking effect of the guide column 72 by properly arranging the guide column 72.

When pushed backwards, the push component 3 drives the limit clamps 9 to be respectively separated from the fixing structures, and the two limit clamps 9 approach each other. That is, the push component 3 drives the sliding surface 344 to move backwards along the first guide surface 81 until the end of the limit fixture block 34 away from the connecting plate 321 is separated from the first groove 8*a*, and the two limit fixture blocks 34 are gradually approached under the push of the pen clip 31 and the adsorption of two magnet columns 341. The push component 3 presses the reset spring 6 to slides axially along the barrel 2 to a first position.

When released, the push component 3 is driven under an action of the reset spring 6 to slide axially along the barrel 2 to a second position such that the guide structure 7 drives the two limit clamps 9 to separate from each other and respectively be in snap-fit with the fixing structures again. That is, the sliding cylinder 32 drives the limit fixture blocks 34 to move backwards along the axial direction of the barrel 2, and when moving to be close to the guide column 72, the two limit fixture blocks 34 are separated and in snap-fit with the second groove 8*b* under the blocking action of the guide column 72, and a tip of the refill emerges from the holder 1.

When pushed backwards again, the push component 3 drives the limit clamps 9 to separate from the fixing structures and then clamp into the fixing structures again. That is, the pen clip 31 drives the sliding cylinder 32 to drive the sliding surface 344 on the limit fixture block 34 to move backwards along the second guide surface 82 until the limit fixture block 34 is separated from the second groove 8*b*. The end of the limit fixture block 34 away from the connecting plate 321 is in snap-fit with the first groove 8*a* again under the push of the pen clip 31, such that the tip of the refill is hidden in the holder 1.

The axial sliding of the refill in the barrel 2 can be realized through the lateral movement of the push component 3, thereby enabling a tip of the pen refill to emerge or hide in the holder 1. Moreover, the refill is always under stable fixation, which not only reduces the consumption of pen case, but also ensures that the pen tip will not be pushed out when the external force applied to the push component 3 is small, protecting the refill from being damaged by collision and preventing external objects from being contaminated with ink.

Described above are only preferred embodiments of the present disclosure, which are not intended to limit the disclosure. Any improvement, replacement and change made by those skilled in the art without departing from the spirit of the disclosure should fall within the scope of the present disclosure.

What is claimed is:

1. A detachable and retractable pen, comprising:

a holder;

a barrel;

a cap; and a push component;

wherein the holder is in threaded connection with a front end of the barrel; the cap is in snap-fit with a rear end of the barrel; the barrel and the holder are configured to receive a refill; the push component is configured to drive the refill to slide axially along the barrel; a first hole is provided on an outer wall of the rear end of the barrel to enable the push component to slide axially in the barrel; a reset spring is provided between an end of the push component inside the barrel and the cap; the refill is engaged with a front portion of the push component in the barrel;

two limit clamps are symmetrically provided in the push component; and the two limit clamps are in snap-fit with the barrel, respectively;

two fixing structures are symmetrically provided on an inner wall of the rear end of the barrel for positioning of the two limit clamps; a guide structure is provided on the inner wall of the rear end of the barrel and is configured to drive the two limit clamps to respectively clamp with the fixing structures;

when the push component is pushed backwards, the two limit clamps separate from the fixing structures and the two limit clamps approach each other; and the reset spring is pressed by the push component to slide axially along the barrel to a first position;

when the push component is released, the push component is driven under an action of the reset spring to slide axially along the barrel to a second position, such that the guide structure drives the two limit clamps to separate from each other and be respectively in snap-fit with the fixing structures again and a tip of the refill emerges from the holder;

when pushed backwards again, the push component drives the two limit clamps to separate from the fixing structures and then be in snap-fit with the fixing structures again such that the tip of the refill is hidden in the holder;

the push component comprises a pen clip and a sliding cylinder; the pen clip is fixedly connected to a side of the sliding cylinder and is located outside the barrel; a rear portion of the sliding cylinder is fixed with a positioning cylinder; the reset spring is located between the positioning cylinder and the cap; a connecting plate is fixed on an inner wall of a front portion of the sliding cylinder, a pen groove is formed between the connecting plate and the inner wall of front portion of the sliding cylinder to enable the refill to be in snap-fit therewith; an outer wall of the sliding cylinder is provided with two second holes which are symmetrical with respect to an axis of the sliding cylinder; and the two limit clamps are fixed at a rear side of the connecting plate;

each limit clamp comprises one limit fixture block, the two limit fixture blocks are symmetrically fixed at the rear side of the connecting plate; a sliding surface is provided on an outer wall of a rear portion of each limit fixture block; ends of the limit fixture blocks away from the connecting plate protrude from the second holes and are respectively in snap-fit with the fixing structures; the rear portion of each limit fixture block is fixed with a magnet column; adjacent magnetic poles of the two magnet columns are opposite; and a magnetic attraction force between the two magnet columns is less than an elastic force of the reset spring;

each fixing structure comprises a first groove and a second groove; the first groove and the second groove are provided on the inner wall of the rear end of the barrel; a rear portion of the first groove is provided with a first guide surface; a rear portion of the second groove is provided with a second guide surface; the end of each limit fixture block away from the connecting plate is clamped in the first groove; and the sliding surface is in contact with the first guide surface.

2. The detachable and retractable pen of claim 1, wherein a distance between a rear end of the first hole and a rear end of the pen clip is larger than or equal to a maximum elastic displacement of the reset spring, and smaller than or equal to a distance between the positioning cylinder and the cap.

3. The detachable and retractable pen of claim 1, wherein opposite surfaces of the two limit fixture blocks are provided with a positioning block and a positioning groove, respectively; and the positioning block and the positioning groove are in snap-fit with each other.

4. The detachable and retractable pen of claim 1, wherein the first guide surface is larger than the second guide surface in area.

5. The detachable and retractable pen of claim 1, wherein the guide structure comprises a cushion block fixed on the inner wall of the rear end of the barrel and a guide column fixed on the cushion block; the cushion block is provided at an inner wall of a side of the barrel away from the pen clip, and located at a center line of the two limit fixture blocks; and a maximum distance between the cushion block and the inner wall of the side of the barrel away from the pen clip is lower than a maximum distance between the first groove and the inner wall of the side of the barrel away from the pen clip and a maximum distance between the second groove and the inner wall of the side of the barrel away from the pen clip; and the guide column is located between the two limit fixture blocks.

6. The detachable and retractable pen of claim 5, wherein a maximum distance between a surface of the guide column close to the pen clip and the inner wall of the side of the barrel away from the pen clip is larger than a maximum distance between a surface of each limit fixture block away from the pen clip and the inner wall of the side of the barrel away from the pen clip.

7. The detachable and retractable pen of claim 1, wherein a positioning protrusion is fixed on a surface of the cap located inside the barrel; and the positioning protrusion is inserted into the reset spring.

* * * * *